US010876322B2

(12) United States Patent
Yoshida

(10) Patent No.: US 10,876,322 B2
(45) Date of Patent: Dec. 29, 2020

(54) LOCKING DEVICE

(71) Applicant: Travel Sentry SaRL, Geneva (CH)

(72) Inventor: Tomohiro Yoshida, Kita-ku (JP)

(73) Assignee: Travel Sentry SaRL, Geneva (CH)

( * ) Notice: Subject to any disclaimer, the term of this patent is extended or adjusted under 35 U.S.C. 154(b) by 0 days.

(21) Appl. No.: 16/465,671

(22) PCT Filed: Apr. 28, 2017

(86) PCT No.: PCT/JP2017/017063
§ 371 (c)(1),
(2) Date: May 31, 2019

(87) PCT Pub. No.: WO2018/100764
PCT Pub. Date: Jun. 7, 2018

(65) Prior Publication Data

US 2019/0301200 A1 Oct. 3, 2019

(30) Foreign Application Priority Data

Dec. 1, 2016 (JP) ..... 2016-234378

(51) Int. Cl.
*E05B 29/00* (2006.01)
*E05B 19/00* (2006.01)
(Continued)

(52) U.S. Cl.
CPC ..... *E05B 29/006* (2013.01); *E05B 19/0052* (2013.01); *E05B 27/0021* (2013.01);
(Continued)

(58) Field of Classification Search
CPC .... E05B 29/006; E05B 27/00; E05B 27/0021; E05B 27/08; E05B 19/0052; E05B 2700/0025; E05B 15/08
(Continued)

(56) References Cited

U.S. PATENT DOCUMENTS 1,438,336 A * 12/1922 Schroeder ..... E05B 19/0017 70/493
1,589,256 A * 6/1926 Spruth ..... E05B 29/0013 70/366
(Continued)

FOREIGN PATENT DOCUMENTS

CN 201513013 U 6/2010
EP 1279788 A1 * 1/2003 ..... E05B 21/066
(Continued)

OTHER PUBLICATIONS

Extended European Search Report dated May 27, 2020 in corresponding European Patent Application No. 17875931.2 citing documents AO-AQ therein, 9 pages.
(Continued)

*Primary Examiner* — Suzanne L Barrett
(74) *Attorney, Agent, or Firm* — Oblon, McClelland, Maier & Neustadt, L.L.P.

(57) ABSTRACT

The locking device includes a key having a cylindrical shaft in which a guide groove is formed in the axial direction, and a cylinder lock which includes an outer cylinder, an inner cylinder, a locking bar and a tumbler, the inner cylinder has an inner cylinder main body rotatably accommodated in the outer cylinder, a rod fixed to the inner cylinder main body, and a key insertion slot, the locking bar is interposed between the inner cylinder main body and the outer cylinder and prevents the rotation of the inner cylinder by engaging and disengagingly locking the inner cylinder main body and the outer cylinder, and the tumbler has a guide convex portion engageably and detachably engaged with the key groove, and an inner concave portion rotatably received in the inner cylinder and dropping the locking bar.

18 Claims, 13 Drawing Sheets

(51) Int. Cl.
*E05B 27/00* (2006.01)
*E05B 27/08* (2006.01)

(52) U.S. Cl.
CPC ..... *E05B 27/08* (2013.01); *E05B 29/00* (2013.01); *E05B 2027/0025* (2013.01)

(58) Field of Classification Search
USPC ..... 70/357, 358, 490, 491, 365, 366, 377, 70/387, 403, 404, 453, 454
See application file for complete search history.

(56) References Cited

U.S. PATENT DOCUMENTS 2,217,047 A * 10/1940 Fitz Gerald ..... E05B 21/066 70/366
2,292,515 A * 8/1942 George ..... E05B 27/083 70/491
3,552,159 A * 1/1971 Craig ..... E05B 47/0038 70/276
3,702,550 A * 11/1972 Shimizu ..... B60R 25/02142 70/252
3,789,638 A * 2/1974 Roberts ..... E05B 21/066 70/366
4,351,172 A * 9/1982 Martikainen ..... E05B 21/066 70/366
4,370,875 A * 2/1983 Piiroinen ..... E05B 21/066 70/422
5,613,389 A * 3/1997 Hauser ..... E05B 29/0013 70/366
5,927,115 A * 7/1999 Feder ..... E05B 15/08 70/419
6,058,752 A * 5/2000 Feder ..... E05B 15/08 70/419
6,170,307 B1 * 1/2001 Feder ..... E05B 15/08 70/373
6,584,819 B1 * 7/2003 Hung ..... E05B 27/083 70/358
6,725,696 B1 * 4/2004 Blight ..... B23C 3/35 70/366
6,748,777 B1 * 6/2004 Livingston ..... E05B 9/086 70/369
6,758,074 B1 7/2004 Prunbauer
6,799,447 B2 * 10/2004 Mielonen ..... E05B 21/066 70/366
2003/0051521 A1 3/2003 Mielonen et al.
2009/0031772 A1 * 2/2009 Yamaguchi ..... E05B 85/16 70/453
2012/0067091 A1 * 3/2012 Agbay ..... E05B 21/066 70/284
2014/0373581 A1 * 12/2014 Uljens ..... E05B 29/0013 70/357
2016/0312493 A1 10/2016 Yano

FOREIGN PATENT DOCUMENTS

EP 1 350 909 A1 10/2003
EP 2453084 A2 * 5/2012 ..... E05B 21/066
GB 646486 A * 11/1950 ..... E05B 21/066
JP 62-63782 A 3/1987
JP 4-26031 B2 5/1992
JP 2000-96889 A 4/2000
JP 3764728 B2 4/2006
JP 2015-113657 A 6/2015
WO WO-2008034345 * 3/2008 ..... E05B 29/10

OTHER PUBLICATIONS

International Search Report dated Jul. 11, 2017, in PCT/JP2017/017063 filed on Apr. 28, 2017.

* cited by examiner

LOCKING DEVICE

CROSS-REFERENCE TO RELATED APPLICATIONS

This application is a United States national stage application of International Application No. PCT/JP2017/017063, filed Apr. 28, 2017, which designates the United States, and claims priority to Japan Patent Application No. 2016-234378, filed Dec. 1, 2016, and the entire contents of each of the above applications are hereby incorporated herein by reference in entirety.

TECHNICAL FIELD

An Embodiment of the present invention relates to a locking device including a key and a cylinder lock having an inner cylinder rotated by the key.

BACKGROUND ART

Conventionally, various cylinder locks have been known. A certain type of cylinder lock rotatably accommodates an inner cylinder having a key insertion slot in an outer cylinder fixed to a mounting object such as a hook. Furthermore, the cylinder lock is provided with multiple tumblers so as to straddle the outer cylinder and the inner cylinder, and the outer cylinder and the inner cylinder are directly engageable with and disengageable from each other (see, for example, Patent Document 1).

Then, when a regular mechanical key that is not counterfeit or the like is inserted into the key insertion port, all the tumblers are driven to release the locked state between the outer cylinder and the inner cylinder, so the inner cylinder is able to be rotated with respect to the outer cylinder.

By rotating the key by a required angle and rotating the inner cylinder by a required angle, a cam mechanism or the like in the inner cylinder is driven to drive a deadbolt, and locking or unlocking is performed.

On the other hand, there is also known a technology in which a locking bar is provided so as to straddle the outer cylinder and the inner cylinder in place of the above-mentioned tumblers, and the both cylinders are locked (see, for example, Patent Document 2).

CITATION LIST

Patent Document

Patent Document 1: Japanese Patent Laid-Open No. 2015-113657

Patent Document 2: Japanese Patent Laid-Open No. 2000-096889

SUMMARY OF INVENTION

Problems to be Solved by the Invention

However, the technique disclosed by Patent Document 1 includes a spring 25 or the like such as springs 50 and 58, which energizes one end of multiple tumblers 22 and 23 to the outer periphery of the inner cylinder such as an inner cylinder 13. For example, the springs 25 and the like are springs 50 and 58. As a result, Patent Document 1 has a problem that the number of parts is large and the configuration of the entire cylinder lock is complicated.

In addition, the key disclosed in Patent Document 2 has a problem that forgery is easy because the key 2 is formed of a flat plate.

The problem to be solved by the present invention is to provide a locking device which is simple in construction by reducing the number of parts by driving a tumbler without using a spring, etc., so that it is not easy to forge a key.

Means for Solving the Problems

A locking device according to an embodiment includes a key and a cylinder lock, having a cylindrical shaft in which a guide groove is formed in an axial direction.

The cylinder lock includes an outer cylinder, an inner cylinder, and a tumbler. The inner cylinder has an inner cylinder main body rotatably accommodated in the outer cylinder, a rod fixed to the inner cylinder main body, a key insertion slot, and a key insertion guide. The key insertion guide is fixed to the inner cylinder main body so as to be located in the key insertion slot. The tumbler has a locking bar and an inner concave portion. The locking bar is interposed between the inner cylinder and the outer cylinder, and is engaged with and disengaged from the inner cylinder and the outer cylinder to prevent the rotation of the inner cylinder. The inner concave portion is rotatably accommodated in the inner cylinder so as to rotatably engage with the guide groove of the key and to drop the locking bar.

When the shaft of the key is inserted inward from the key insertion slot of the inner cylinder along the key insertion guide, it works as follows. The guide convex portion is engaged with the guide groove of the key. The tumbler is rotated along the guide groove of the key to align the inner concave portion with the position of the locking bar. The locking bar is inserted radially in the bar insertion hole of the inner cylinder. The locked state of the inner cylinder and the outer cylinder is released by dropping the locking bar to the inner concave portion side of the tumbler. Thus, the inner cylinder is made rotatable.

Advantages of the Invention

According to the present invention, it is possible to provide a locking device which is simple in construction by reducing the number of parts by driving a tumbler without using a spring, etc., so that is not easy to forge a key.

BRIEF DESCRIPTION OF THE DRAWINGS

FIG. 13 is a plan view of the spacer shown in FIG. 12 and the like.

FIG. 14A is a plan view of the first stage tumbler shown in FIG. 12 and the like.

DESCRIPTION OF EMBODIMENTS

Figure 1B:
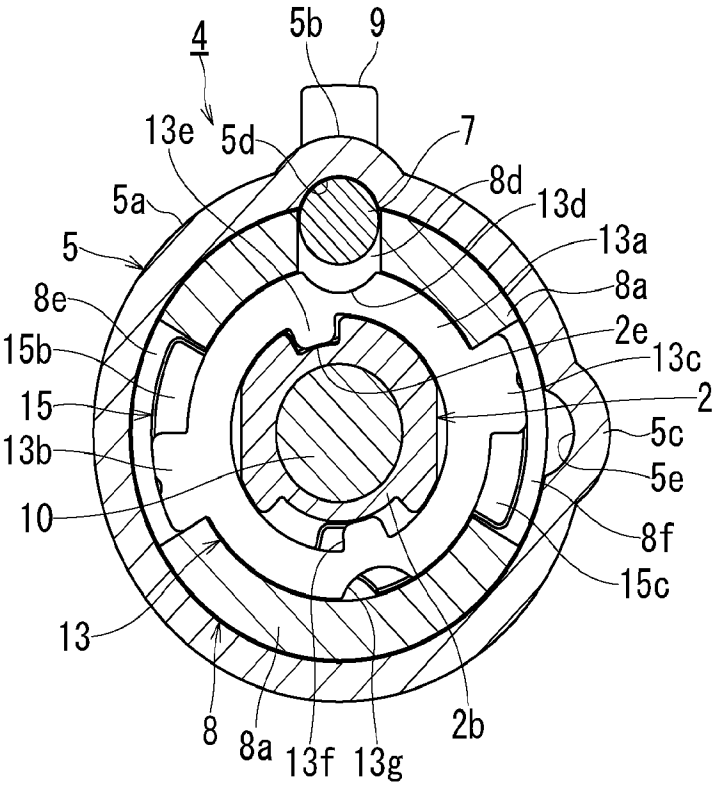
FIG. 1B is a cross-sectional view taken along a line II in FIG. 5 when a key is inserted into a key insertion slot of a cylinder lock.

Hereinafter, a present embodiment will be described with reference to the drawings. In the drawings, the same or corresponding parts are denoted by the same reference numerals.

Figure 4:
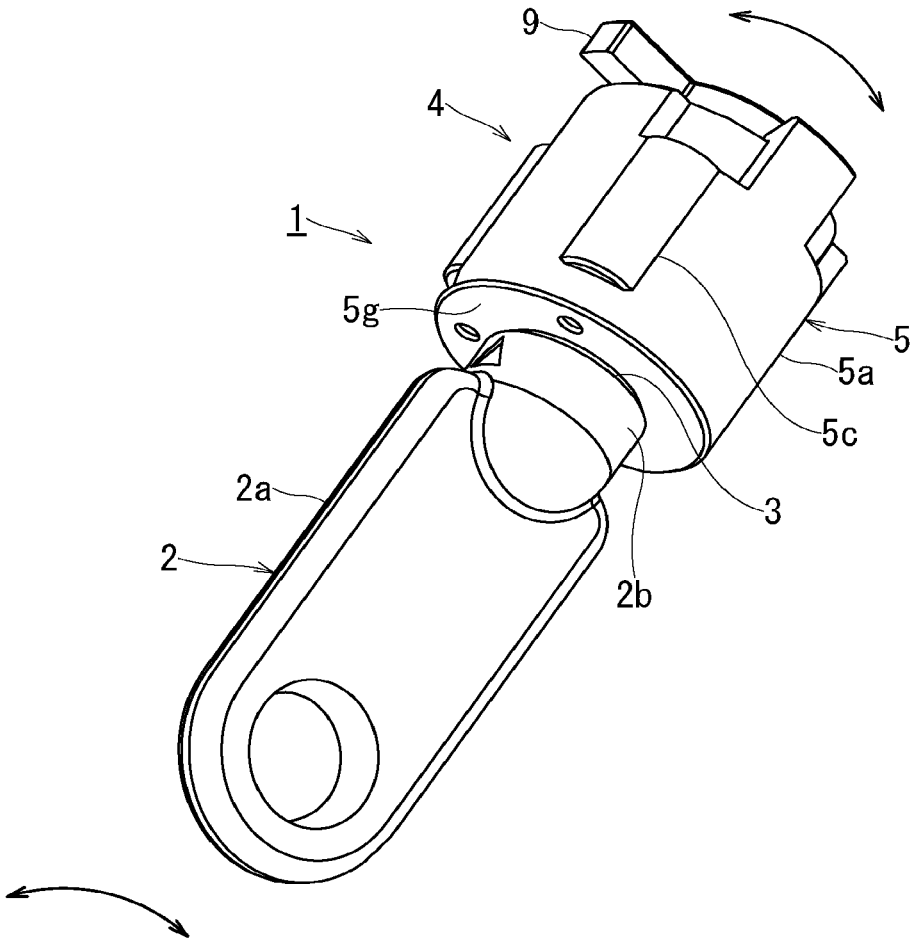
FIG. 4 is a perspective view of the locking device in a state in which a shaft of the key is inserted into the key insertion slot of the cylinder lock.
Figure 5:
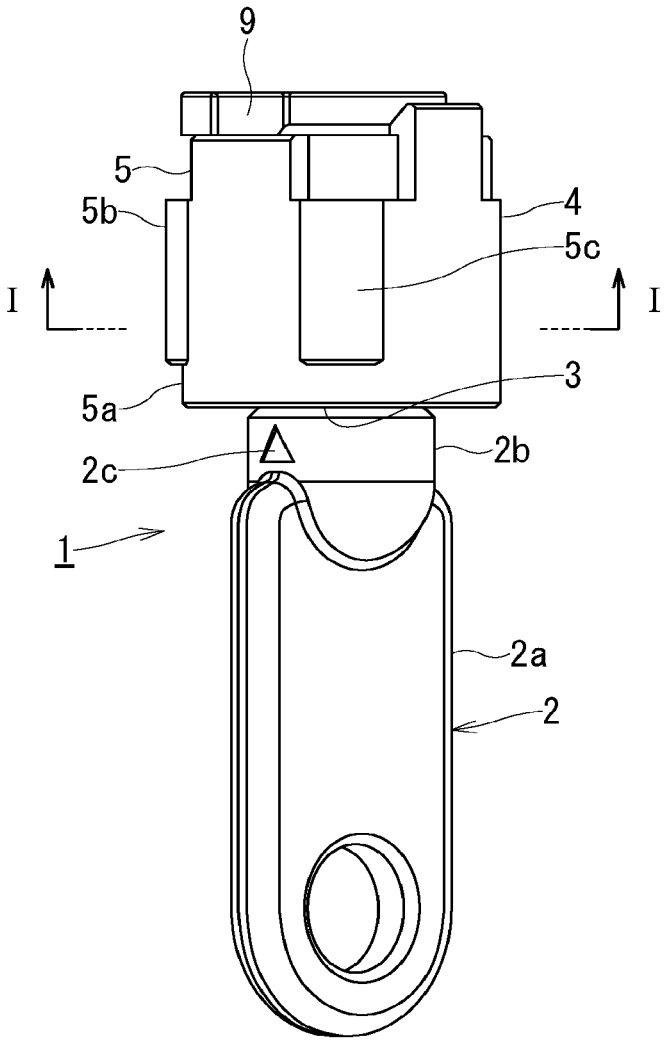
FIG. 5 is a plan view of the locking device shown in FIG. 4.

FIGS. 4 and 5 are perspective views showing a locking device 1 in a state in which a key according to a present embodiment is inserted into a key insertion slot of a cylinder lock.

As shown in FIGS. 4 and 5, the locking device 1 includes a metal key 2 made of zinc alloy or the like and a cylinder lock 4. The cylinder lock 4 is substantially entirely made of a synthetic resin and has a key insertion slot 3 into which the key 2 is inserted.

As shown in FIGS. 4 to 7, the key 2 has a cylindrical shaft 2*b* coaxially and integrally coupled to a flat grip 2*a* which is able to be gripped by a user.

The shaft 2*b* includes key insertion marks 2*c* and 2*d* with relief or the like on the one end portion on the grip 2*a* side, respectively indicating an insertion position and an insertion direction of the key 2 at a predetermined interval in an axial direction. For example, each of the key insertion marks 2*c* and 2*d* is a quadrangle, a triangle or the like, and the marks 2*c* and 2*d* form a left and right pair in the drawing.

The shaft 2*b* includes a key groove 2*e* which is an example of a guide groove. In the upper part of FIG. 6, the key groove 2*e* meanders in a zigzag form along the axial direction from the vicinity of the square key insertion mark 2*d*.

The shaft 2*b* has key tip 2*f* (left end in FIGS. 6 and 7) in a circular opening. The shaft 2*b* forms a key groove opening 2*g* by opening a tip (left end in FIG. 6) of the key groove 2*e* at the key tip 2*f*.

As shown in FIG. 4, the cylinder lock 4 includes an outer cylinder 5 made of resin such as POM having a key insertion slot 3. The outer cylinder 5 has a cylindrical outer cylinder main body 5*a* attached to and fixed to an object (not shown) such as a bag and a locking device to which the cylinder lock 4 is attached. For example, the bag includes a suitcase.

Figure 8:
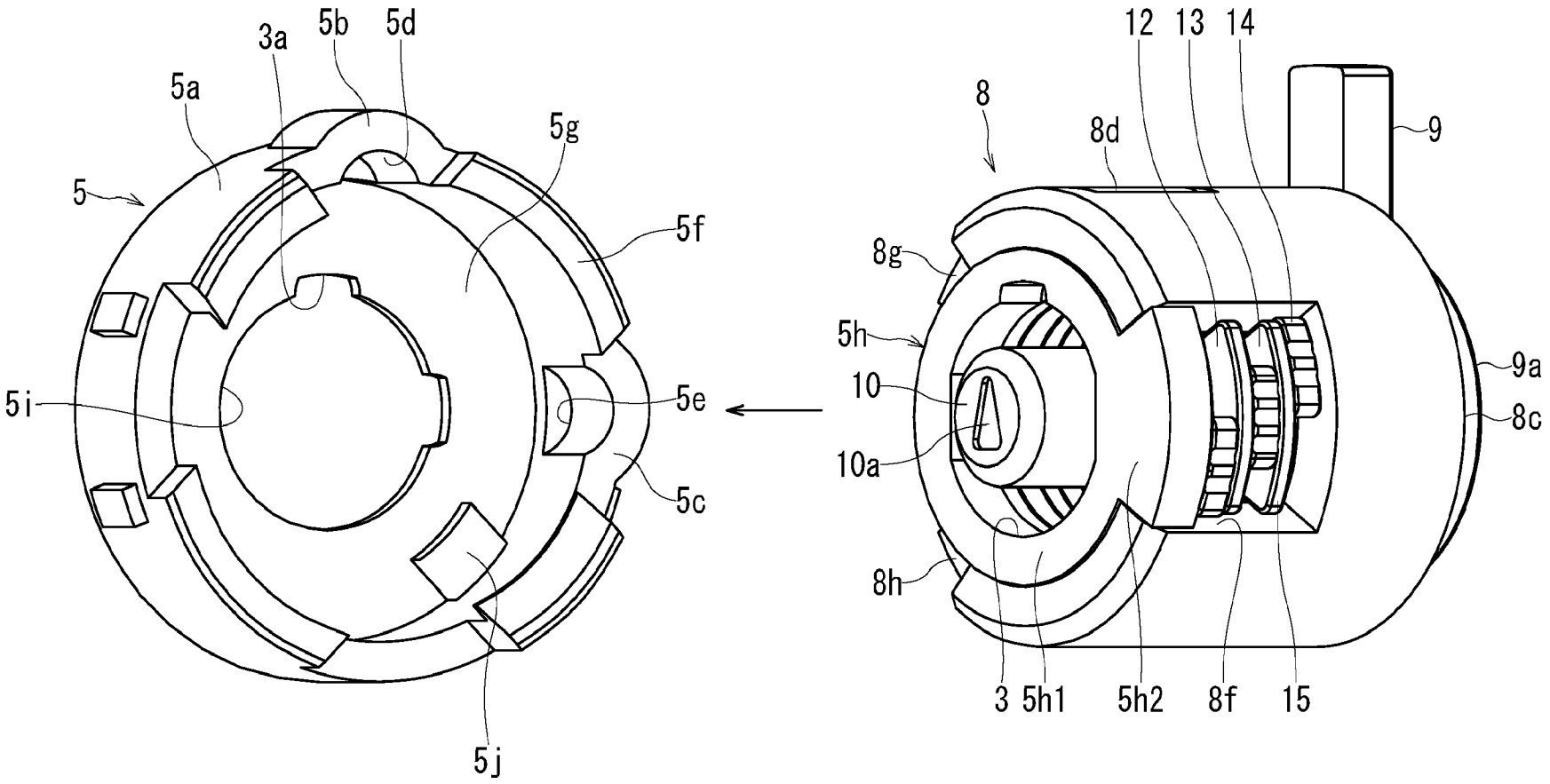
FIG. 8 is a perspective view showing a state in which the inner cylinder is inserted and accommodated in the outer cylinder shown in FIGS. 4 and 5.

As shown in FIG. 8, the outer cylinder main body 5*a* has an opening end 5*f* open at substantially the entire surface at one axial end (right end in FIG. 8). The other axial end in the axial direction of the outer cylinder main body 5*a* is closed by an end plate 5*g*. The end plate 5*g* is formed with a ring fitting hole 5*i* at almost the center thereof in which a guide ring 5*h* for key insertion is fitted and fixed. Further, the end plate 5*g* has a locking convex portion 5*j* protruding from the inner peripheral portion.

Then, as shown in FIGS. 1A to 3B, the outer cylinder 5 has multiple convex portions formed outward on the outer cylinder main body 5*a*. For example, the convex portions are two first and second arc-shaped convex portions 5*b* and 5*c*.

The first and second arc-shaped convex portions 5*b* and 5*c* are formed hollow. The first and second arc-shaped convex portions 5*b* and 5*c* have arc-shaped first and second outer concave portions 5*d* and 5*e* for engagement on the inner surfaces, respectively. Each of the first and second arc-shaped convex portions 5*b* and 5*c* is formed to have a required length in the axial direction of the outer cylinder main body 5*a*. The first and second arc-shaped convex portions 5*b* and 5*c* and the outer concave portions 5*d* and 5*e* are disposed apart from each other in the circumferential direction of the outer cylinder main body 5*a* by a required angle such as 90°. For example, the first arc-shaped convex portion 5*b* and the first outer concave portion 5*d* are formed such that their centers are arranged at the 12 o'clock position on a dial display on a clock (hereinafter referred to as "clock display"). Further, the second arc-shaped convex portion 5*b* and the second outer concave portion 5*e* are formed such that the center of the second outer concave portion 5*d* is arranged at the 3 o'clock position.

Figure 1A:
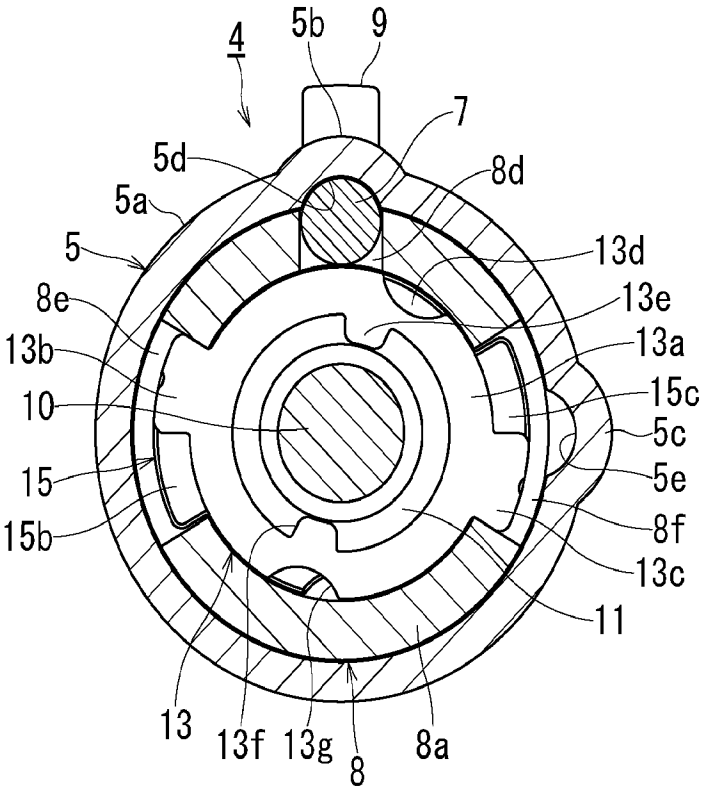
FIG. 1A is a cross-sectional view taken along a line II in FIG. 5 before inserting a key into a key insertion slot of a cylinder lock.

Then, as shown in FIGS. 1A and 1B, etc., the first and second outer concave portions 5*d* and 5*e* accommodate therein a part (the upper part in FIGS. 1A to 3B) of a required elongated cylindrical locking bar 7 in the diametrical direction. The cylindrical locking bar 7 is made of metal such as SUS or the like.

Figure 9B:
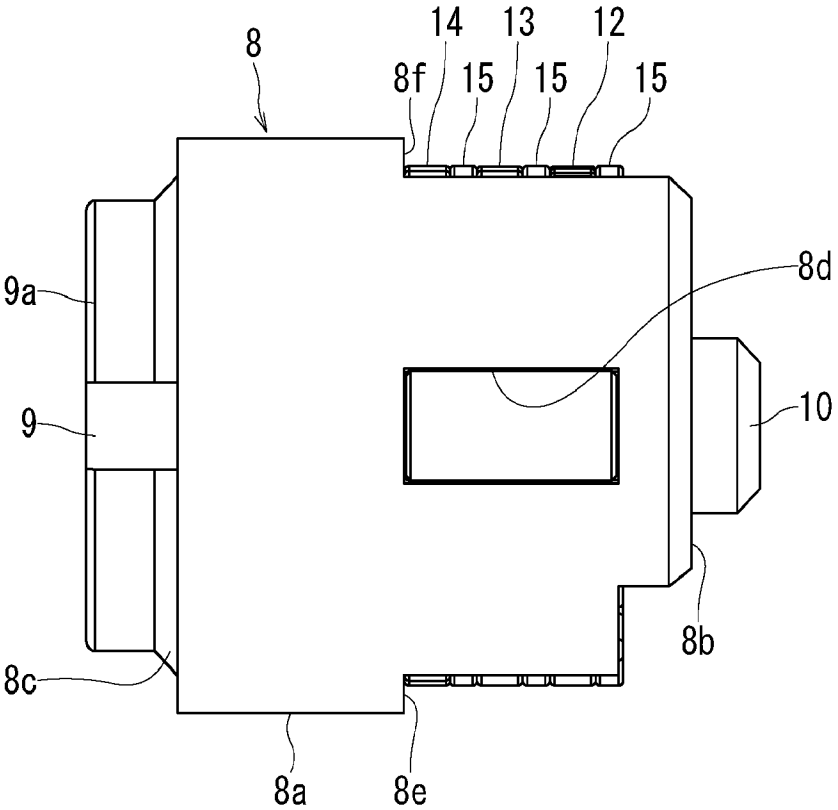
FIG. 9B is a plan view of the inner cylinder.
Figure 9A:
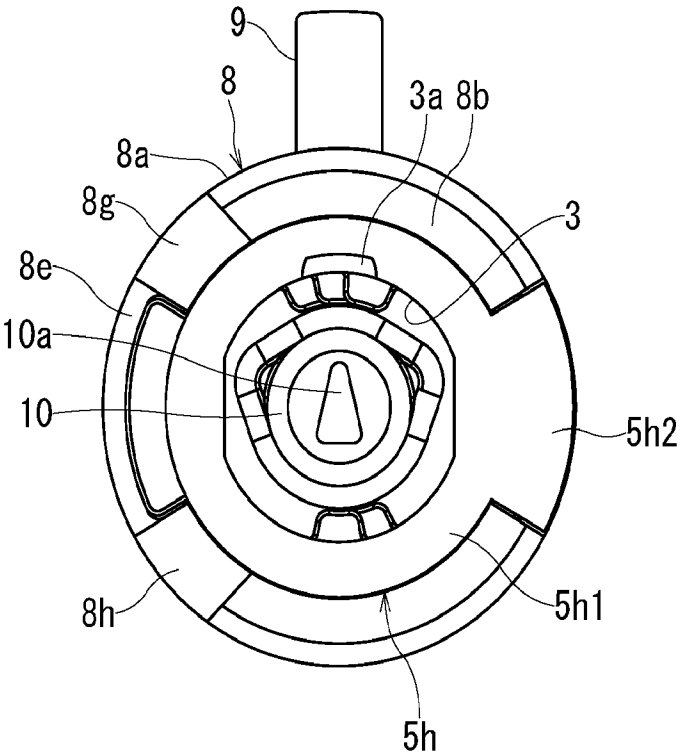
FIG. 9A is a front view of the inner cylinder shown in FIG. 8.
Figure 10B:
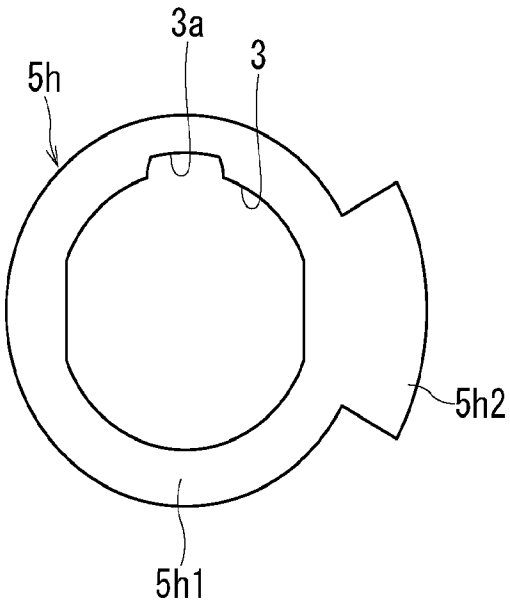
FIG. 10B is a front view of a key insertion guide ring disposed in the key insertion slot of the inner cylinder.
Figure 10A:
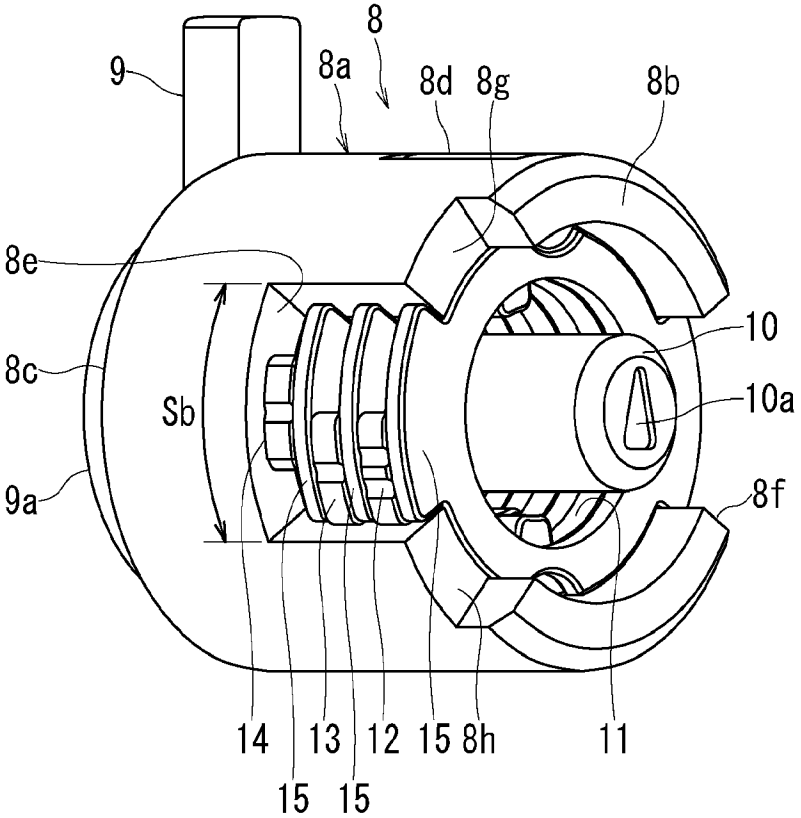
FIG. 10A is a partially omitted perspective view of the inner cylinder shown in FIG. 8.

FIGS. 8 and 10A are perspective views of the inner cylinder (cylinder) 8 rotatably accommodated in the outer cylinder main body 5*a* configured as described above. FIG. 9A is a front view of the inner cylinder 8. FIG. 9B is a plan view of the inner cylinder 8.

Figure 11B:
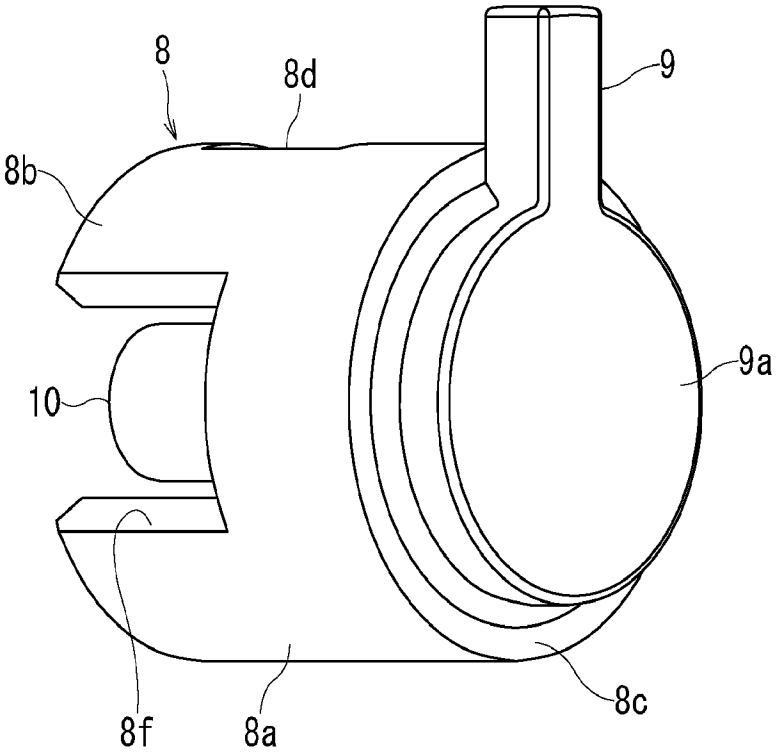
FIG. 11B is a perspective view as viewed from a direction of the arrow B in FIG. 11A.
Figure 11A:
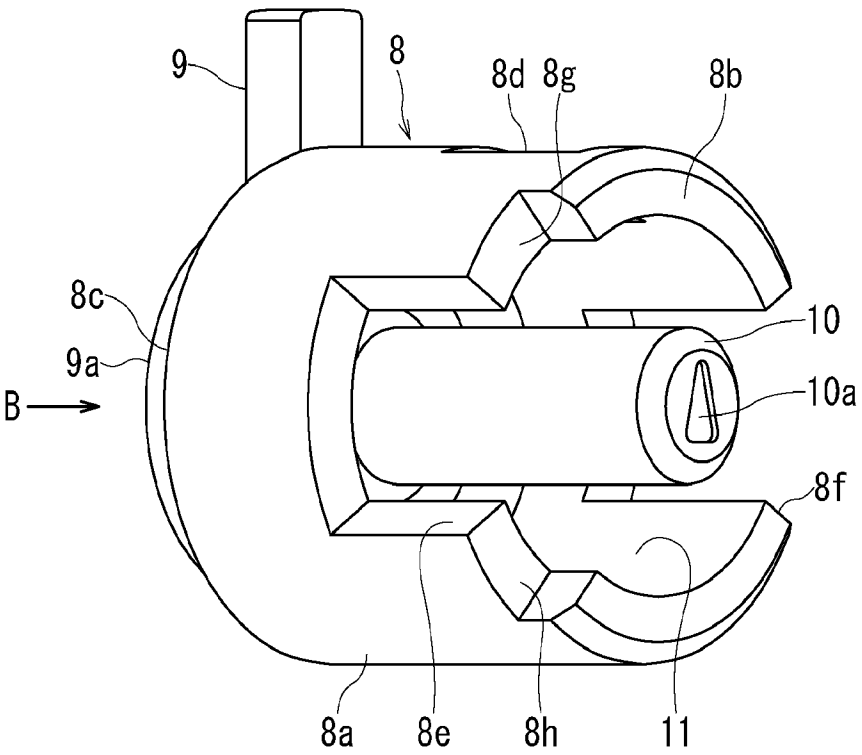
FIG. 11A is a perspective view when the tumbler and spacer of the inner cylinder shown in FIG. 10A are not shown.

As shown in FIGS. 11A and 11B, the inner cylinder 8*h* as a bottomed cylindrical inner cylinder main body 8*a*. The inner cylinder 8 fixes a prismatic rod 9 to the outer surface of an open end 8*b* of the inner cylinder main body 8*a* and a bottom 8*c* on the opposite side in the axial direction via the disk-like base end 9*a*. The prismatic rod 9 is an example of a locking rod. The rod 9 has a free tip protruding outward in the centrifugal direction by a required length from an outer peripheral surface of the inner cylinder main body 8*a*. The protruding end of the rod 9 is detachably engaged with a locking receptacle such as a strike (not shown) so that the rod 9 can be locked or unlocked by rotation of the rod 9.

The inner cylinder 8 is fixed to the outer surface of the bottom 8*c* of the inner cylinder main body 8*a* using a swaging tool of the open end 5*f* of the outer cylinder 5. The bottom of the cylindrical or hollow cylindrical key insertion guide 10 is concentrically fixed and protruded on the center of the inner surface of the bottom 8*c* of the inner cylinder main body 8*a*. The inner cylinder main body 8*a* forms an annular space 11 of a required size around the outer periphery of the key insertion guide 10. The inner cylinder main body 8*a* forms a required outer peripheral space around the key insertion guide 10 as a key insertion space into which the shaft 2*b* of the key 2 is inserted. The key insertion guide 10 protrudes free closing tip surface slightly outward from the open end 8*b* of the inner cylinder main body 8*a*. The free closing tip surface of the key insertion guide 10 is peaked in the same direction as the rod 9 protrudes. For example, in the free closing tip surface, a positioning mark 10*a* in the form of a triangular concave portion whose apex angle is oriented in the same direction as the protruding direction of the rod 9 is formed.

As shown in FIGS. 8, 10A, 11A and 11B, the inner cylinder 8 forms a bar insertion hole 8*d* having a rectangular planar shape, for example, on the upper surface of the inner cylinder main body 8*a* in the drawing. The bar insertion hole 8*d* is formed to penetrate the side wall of the inner cylinder main body 8*a* in the radial direction. As shown in a set of FIGS. 1A and 1B to a set of FIGS. 3A and 3B, the bar insertion hole 8*d* allows the locking bar 7 to be inserted radially toward the center of the inner cylinder main body 8*a*.

The inner cylinder 8 is formed by cutting out a pair of left and right rectangular openings of engaged concave portions 8*e* and 8*f* on the left and right sides (upper and lower parts in FIG. 11A) of the bar insertion hole 8*d* so as to penetrate in the thickness direction. Each of the engaged concave portions 8*e* and 8*f* is an example of an engaged portion.

Figure 12:
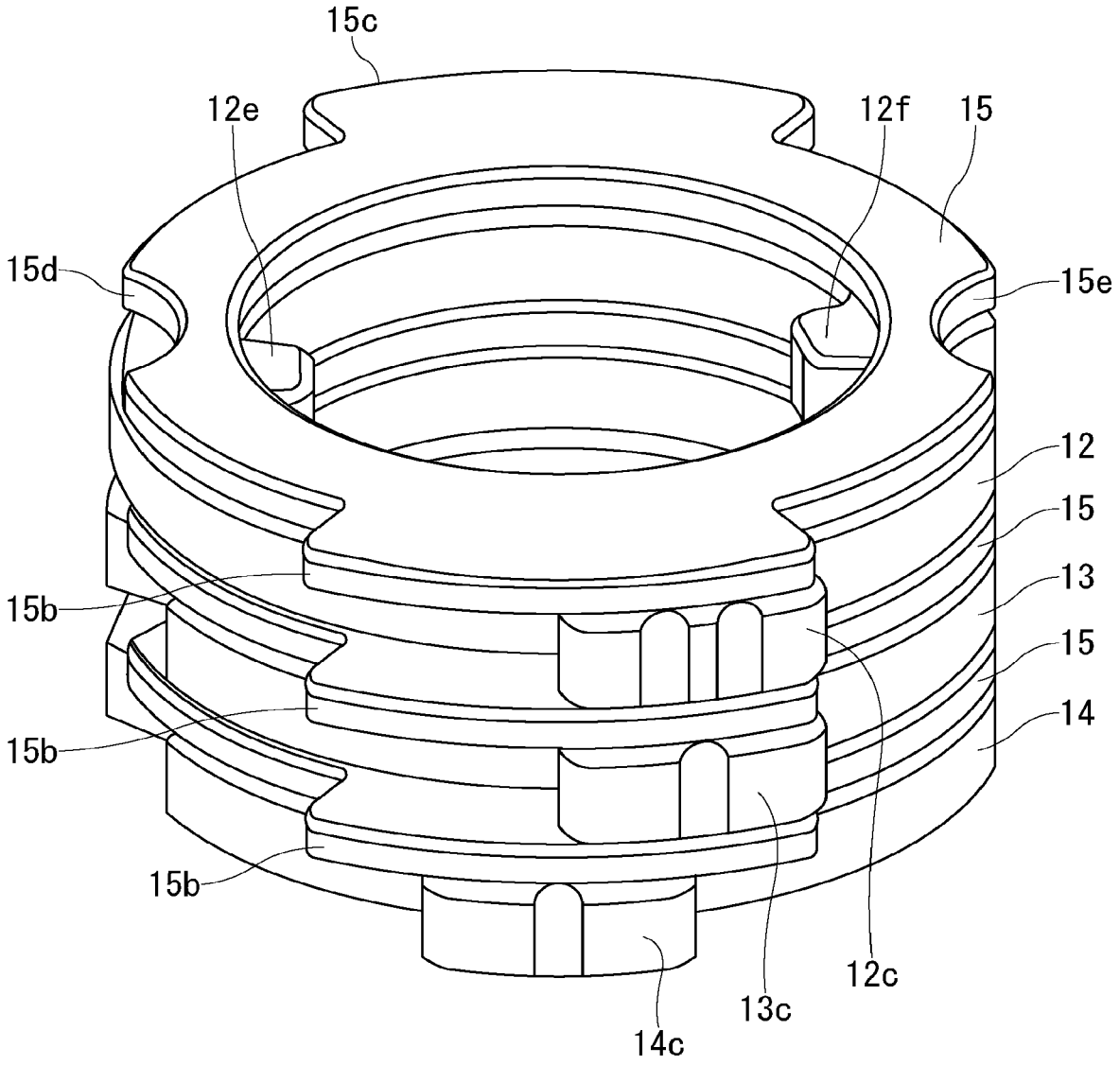
FIG. 12 is a perspective view showing a state in which multiple spacers and multiple of tumblers housed in the inner cylinder shown in FIG. 10A and the like are alternately stacked in the vertical direction in the drawing.

As shown in FIG. 12, the inner cylinder 8 configured in this way houses multiple, for example, the first to third layers (three types) annular brass metal tumblers 12, 13 and 14 and the first to third layer annular spacers 15, 15 and 15 made of PA sheet or the like in the annular space 11 in the inner cylinder main body 8*a* in the state of being alternately stacked in the vertical direction in the figure. The first to third layers of the tumblers 12 to 14 and the first to third layers of spacers 15, 15 and 15 are formed on the front and back surfaces thereof as sliding surfaces that can easily slide.

Figure 14C:
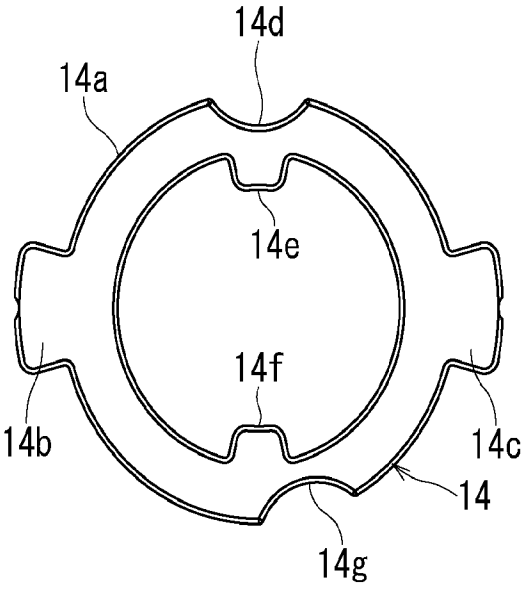
FIG. 14C is a plan view of the third stage tumbler.
Figure 14B:
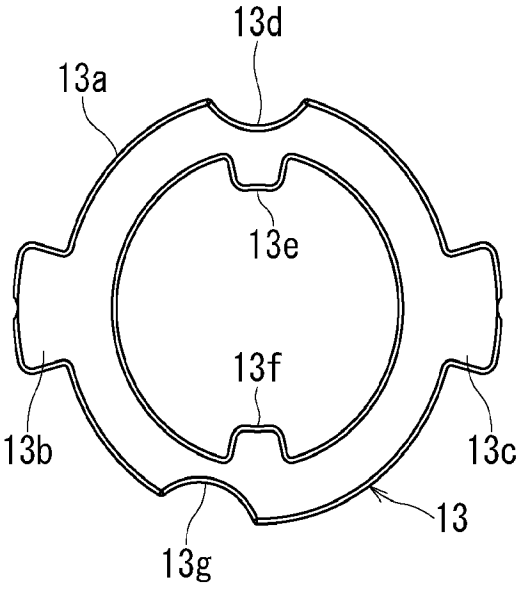
FIG. 14B is a plan view of the second stage tumbler.

As shown in FIG. 14C, a pair of left and right dovetail shaped engaging portions 12*b* and 12*c* in the figure is integrally protruded outward in the horizontal direction (left and right direction in the figure) from the annular tumbler main body 12*a*, thereby the first layer tumbler 12 is formed. As shown in FIG. 14B, a pair of left and right dovetail shaped engaging portions 13*b* and 13*c* in the figure is integrally protruded outward in the horizontal direction (left and right direction in the figure) from the annular tumbler main body 13*a*, thereby the second layer tumbler 13 is formed. As shown in FIG. 14C, a pair of left and right dovetail shaped engaging portions 14*b* and 14*c* in the figure is integrally protruded outward in the horizontal direction (left and right direction in the figure) from the annular tumbler main body 14*a*, thereby the third layer tumbler 14 is formed.

Each of the pairs of engaging portions 12*b* and 12*c*, 13*b* and 13*c*, and 14*b* and 14*c* is formed substantially rectangular in shape and size. The dimension Sa (shown in FIG. 14A) of each pair in the circumferential direction is smaller than the dimension Sb (shown in FIG. 10A) in the circumferential direction of the pair of left and right concave portions 8*e* and 8*f* of the inner cylinder main body 8*a* (Sa<Sb). Each of the engaging portions 12*b* and 12*c*, 13*b* and 13*c*, 14*b* and 14*c* are fitted with backlash space so as to be slightly rotatable in the circumferential direction in the respective engaged concave portions 8*e* and 8*f*.

Figure 14A:
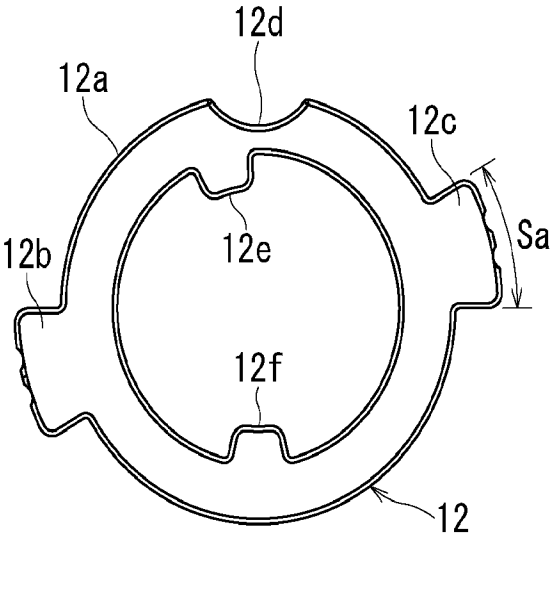

Then, in FIGS. 14A to 14C showing the tumbler main bodies 12*a*, 13*a* and 14*a* respectively, the tumblers 12 to 14 include arc-shaped inner concave portions 12*d*, 13*d* and 14*d* for engagement and each being recessed toward the annular center at the outer peripheral portion of the upper portion (12 o'clock in clock display) and each opening outward.

As shown in FIGS. 1A to 3B, the arc shape and dimensions of each of the inner concave portions 12*d*, 13*d* and 14*d* are designed to fit in the radial lower part of the locking bar 7 and to receive the locking bar 7.

Further, a pair of upper and lower guide convex portions 12*e* and 12*f* protruding in the annular center direction is provided to protrude from the inner peripheral portion of the annular tumbler main body 12*a*, thereby, the first layer tumbler 12 is formed. A pair of upper and lower guide convex portions 13*e* and 13*f* protruding in the annular center direction is provided to protrude from the inner peripheral portion of the annular tumbler main body 13*a*, thereby the second layer tumbler 13 is formed. A pair of upper and lower guide convex portions 14*e* and 14*f* protruding in the annular center direction is provided to protrude from the inner peripheral portion of the annular tumbler main body 14*a*, thereby the third layer tumbler 14 is formed.

Figure 6:
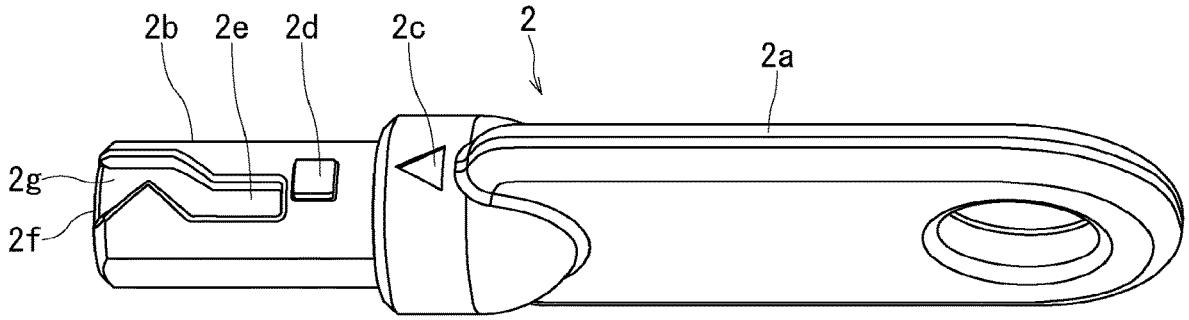
FIG. 6 is a perspective view of the key shown in FIGS. 4 and 5.
Figure 7:
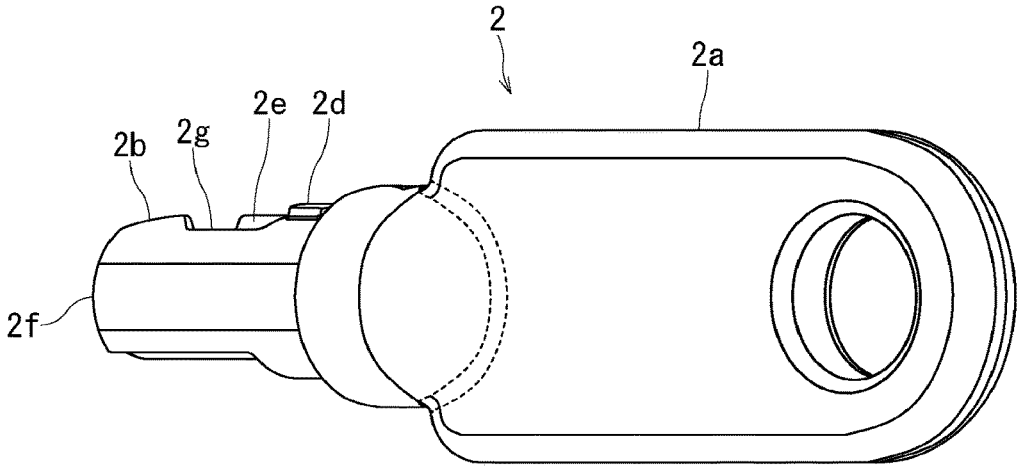
FIG. 7 is a perspective view of the key shown in FIG. 6 as viewed from the right side in FIG. 6.

The upper guide convex portions 12*e*, 13*e* and 14*e* engage with the upper key groove 2*e* of the key 2 shown in FIG. 6 etc. The guide convex portions 12*e*, 13*e* and 14*e* rotate in the circumferential direction according to the meandering as inserted deeply along the key groove 2*e* is inserted deep. The rotation rotates each tumbler main body 12*a*, 13*a* and 14*a* in the circumferential direction by a required angle. As shown in FIGS. 14A to 14C, the guide convex portions 12*e*, 13*e* and 14*e* guide all of the inner concave portions 12*d*, 13*d* and 14*d* to coincide at a predetermined position. For example, the predetermined position is a twelve o'clock position on the clock display. That is, the key groove 2*e* of the key 2 rotates the tumblers 12 to 14 of the first to third layers by predetermined angles by simply inserting the shaft 2*b* of the key 2 into the key insertion slot 3. The key grooves 2*e* of the key 2 are all aligned at the 12 o'clock position in the inner concave portions 12*d*, 13*d* and 14*d*.

The positional relationship between the inner concave portions 12*d* to 14*d* and the guide convex portions 12*e* to 14*e* at the top is slightly different for each of the first to third layers of the tumblers 12 to 14. The positional relationship is slightly shifted in the stacking direction of the first to third stage tumblers 12 to 14. However, the tumblers 12 to 14 of the first to third layers do not have to be entirely shifted in the stacking direction. The tumblers 12 to 14 may be one or more than one.

Figure 13:
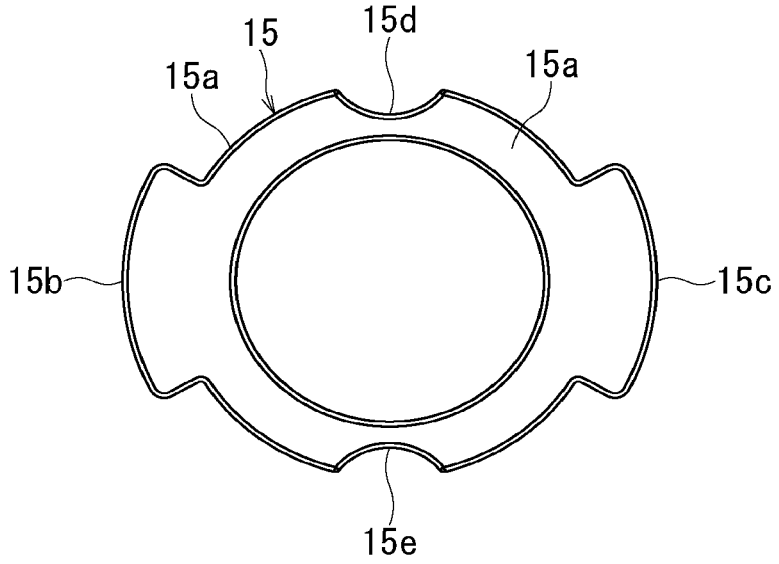

As shown in FIG. 13, each of the first to third layers of the spacers 15, 15 and 15 has annular spacer bodies 15*a*, 15*a* and 15*a*, respectively. The spacer main bodies 15*a*, 15*a* and 15*a* have substantially the same planar shape and the same size as the tumbler main bodies 12*a* to 14*a* of the tumblers 12 to 14 of the first to third layers, respectively. The front and back surfaces of each of the first to third layers of the spacers 15, 15 and 15 are formed as sliding surfaces having high slidability.

Each spacer main body 15*a* forms a pair of left and right engaging portions 15*b* and 15*c*, and a pair of upper and lower arc-shaped inner concave portions 15*d* and 15*e* for engagement in the drawing. FIG. 12 shows the case where each spacer main body 15*a* is formed thinner than each tumbler main body 12*a*, 13*a* and 14*a*, but it does not necessarily have to be thinner.

The pair of left and right engaging portions 15*b* and 15*c* is formed in substantially the same shape as the pair of left and right engaging portions 12*b* and 12*c*, 13*b* and 13*c*, and 14*b* and 14*c* of the first to third layers of the tumblers 12 to 14, respectively. However, the engaging portions 15*b* and 15*c* are formed to be slightly longer in the circumferential direction, for example, about twice as long, and are fitted closely to the pair of left and right engaged concave portions 8*e* and 8*f* of the inner cylinder main body 8*a*. The pair of left and right engaging portions 15*b* and 15*c* are substantially prevented from rotating even when the first to third layers of tumblers 12 to 14 rotate in the circumferential direction.

In FIG. 13, when the pair of left and right engaging portions 15*b* and 15*c* is fitted in the pair of left and right engaged concave portions 8*e* and 8*f* of the inner cylinder 8, the upper inner concave portion 15*d* is arranged at 12 o'clock, similarly, the inner concave portion 15*e* shown at the bottom of the figure is arranged at 6 o'clock.

As shown in FIG. 10B, the guide ring 5*h* includes an annular ring main body 5*h*1 and a dovetail shaped engaging portions 5*h*2, then the guide ring 5*h* integrally couples a dovetail shaped engaging portions 5*h*2 protruding outward to the right side in the figure of the outer peripheral part of the ring main body 5*h*1. The guide ring 5*h* forms a key insertion slot 3 in its circular inner peripheral portion, through which the shaft 2*b* of the key 2 is inserted. The key insertion slot 3 is formed in a shape and a size that conforms to the cross section of the shaft 2*b* of the key 2. The key insertion slot 3 has a rectangular concave portion 3*a* formed in the upper part of FIG. 8 for inserting a rectangular key insertion mark 2*d* of the key 2.

The guide ring 5*h* is disposed on the inner side of the open end 8*b* of the inner cylinder 8 shown in FIG. 10A and on the top surface of the first stage spacer 15. The guide ring 5*h* fixes the engaging portions 5*h*2 by fitting the engaging portions 5*h*2 in one end (left end in FIG. 8) on the side of the open end 8*b* of any one of the concave portions. For example, any one of the engaged concave portions is "8f".

As shown in FIGS. 8 and 10A, the inner cylinder 8 is formed with a pair of upper and lower rotation restricting grooves 8*g* and 8*h* in the drawing. The inner cylinder 8 is formed on the diametrically opposite side of the engaged concave portion 8*f* in which the engaging portions 5*h*2 of the guide ring 5*h* is fitted at the open end 8*b*.

The pair of upper and lower rotation restricting grooves 8*g* and 8*h* is formed at a required central angle, such as "90°", so as to straddle between circumferentially opposite end portions of either one of the concave portions, such as "8*e*", for engagement. The rotation restricting grooves 8*g* and 8*h* are slidably engaged with the locking convex portion 5*j* in the outer cylinder 5 shown in FIG. 8, and are configured as rotation angle restricting means or unit for restricting the rotation angle of the inner cylinder 8.

That is, the rotation angle restricting means is formed such that the rotation center angle thereof is equal to the rotation center angle from the center of the first outer concave portion 5*d* to the center of the second outer concave portion 5*e*. The first outer concave portion 5*d* is in the first arc-shaped convex portion 5*b* of the outer cylinder 5. The second outer concave portion 5*e* is in the second arc-shaped convex portion 5*c*. That is, the inner cylinder 8 is configured to be able to rotate 90° reversibly. It should be noted that the rotation center angle may not be 90°, and may be changed as needed.

Subsequently, an operation of the locking device 1 configured as described above will be described.

Before inserting the shaft 2*b* of the key 2 into the key insertion slot 3 of the cylinder lock 4, the cylinder lock 4 is in the state as shown in FIG. 1A. In the drawing, the radial upper half portion of the locking bar 7 engages in the first outer concave portion 5*d* of the outer cylinder 5. The remaining lower half in the figure engages in the bar insertion hole 8*d* of the inner cylinder 8. At this time, in the locking bar 7, the arc-shaped lower surface in the drawing is in contact with the outer peripheral surface of each of the tumbler main bodies 12*a* to 14*a*. By turning the tumblers 12*a* to 14*a* about the central axis, the locking bar 7 itself can also be slightly rotated about the central axis.

As shown in FIG. 1A, when the locking bar 7 is interposed between the inner peripheral surface of the outer cylinder 5 and the outer peripheral surface of the inner cylinder 8, the outer cylinder 5 and the inner cylinder 8 are locked by the locking bar 7. Therefore, the inner cylinder 8 cannot be rotated substantially.

Therefore, as shown in FIG. 4, the cylindrical shaft 2*b* of the key 2 is inserted into the key insertion slot 3 of the cylinder lock 4. When the shaft portion 2*b* of the key 2 is inserted, it is inserted after being positioned. The positioning is performed so that the top angle direction of triangle of key insertion mark 2*c* at the root of shaft 2*b* coincides with the apex angle direction of the triangle of the positioning mark 10*a* of the cylindrical key insertion guide 10 shown in FIG. 8A etc.

Then, as shown in FIGS. 1A to 3B, 9A, 9B and 10A etc., the shaft 2*b* of the key 2 is guided by the key insertion guide 10 and the guide ring 5*h*. Then, the shaft 2*b* of the key 2 advances from the first layer to the third layer in the spacers 15, 15 and 15 of the first to third layers in the inner cylinder 8 and in the annular holes of the first to third layer tumblers 12 to 14.

As a result, the upper guide convex portions 12*e*, 13*e*, 14*e* protruding from the inner peripheral portions of the first to third layers of the tumblers 12 to 14 sequentially engage with the key groove 2*e*. At the same time, the first to third layer tumblers 12 to 14 are guided by the insertion pressure and the zigzag meandering of the key groove 2*e* according to the further insertion of the shaft portion 2*b* of the key 2 and the first to third layer tumblers 12 to 14 rotate around their central axes. The required angle is respectively rotated in the left or right direction in the figure. The rotation angle and the rotation direction depend on the bending angle and bending direction of the key groove 2*e* with which each of the guide convex portions 12*e*, 13*e* and 14*e* engages.

Thus, the key 2 is pushed to the back of the predetermined position. At that time, first, as shown in FIG. 1B, all the inner concave portions 12*d*, 13*d* and 14*d* at the top in the drawing of the first to third layer tumblers 12 to 14 are aligned at a predetermined position. For example, the predetermined position is a 12 o'clock position. The position of 12 o'clock corresponds to the position of the locking bar 7 engaged with the first outer concave portion 5*d* of the outer cylinder 5 and the bar insertion hole 8*d* of the inner cylinder 8.

And then, for example, the inner cylinder 8 is turned to rotate the key 2 clockwise in the drawing so as to turn the inner cylinder 8 clockwise. At the start of the rotation, the upper right end of the locking bar 7 accommodated in the bar insertion hole 8*d* of the inner cylinder 8 strikes the lower right end of the first outer engagement recess 5*d*, the upper right end of the locking bar 7 being a portion protruding upward in the figure from the bar insertion hole 8*d*. Thus, the entire locking bar 7 is pressed toward the center of the inner cylinder 8 by the arc surface of the abutment.

Figure 2B:
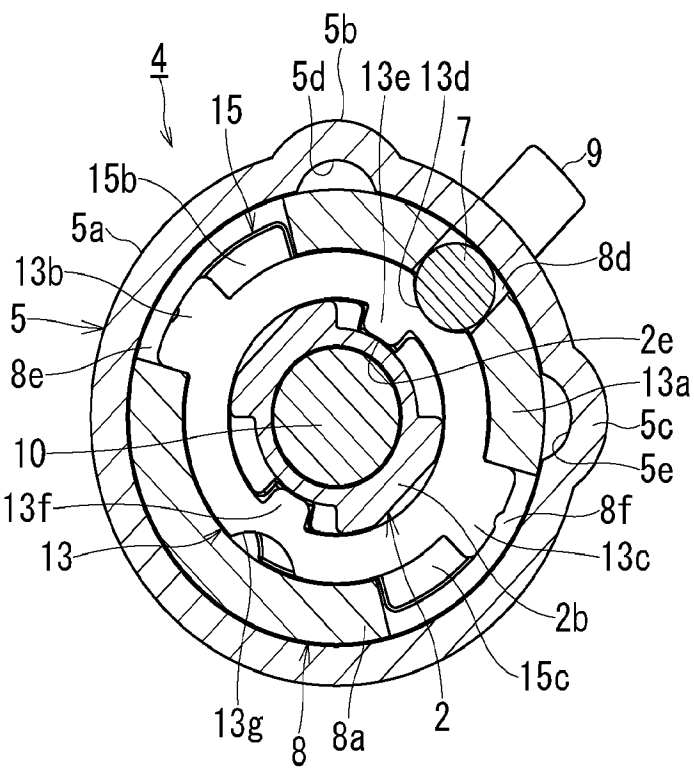
FIG. 2B is a cross-sectional view taken along a line II in FIG. 5 when the key is rotated about 45° after FIG. 2A, for example.
Figure 2A:
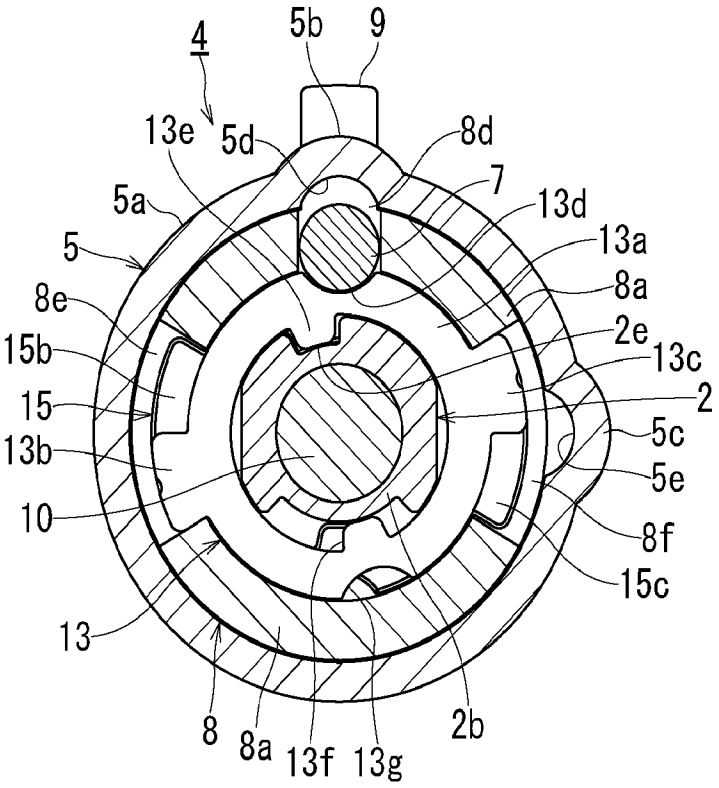
FIG. 2A is a cross-sectional view taken along a line II in FIG. 5 when the inner cylinder is started to rotate, for example, clockwise in the figure by the turning operation of the key after inserting the key into the key insertion slot.

Therefore, as shown in FIG. 2A, the entire locking bar 7 is inserted downward in the bar insertion hole 8*d* of the inner cylinder 8 in the figure. The arcuate lower end portion of the locking bar 7 is pushed into the upper inner concave portions 12*d*, 13*d* and 14*d* of the first to third layers of the tumbler bodies 12*a* to 14*a*.

As a result, the locking bar 7 is interposed between the inner peripheral surface of the outer cylinder main body 5*a* and the outer peripheral surface of the inner cylinder main body 8*a*, and the locked state in which both are locked is released. That is, the inner cylinder 8 is able to be rotated in the outer cylinder 5.

Next, as shown in FIG. 2B, the key 2 is further turned clockwise. Then, the entire inner cylinder 8 is rotated clockwise together with the key insertion guide 10. Thereby, the locking bar 7 rotates by a predetermined angle while sliding on the inner peripheral surface of the outer cylinder main body 5*a* in a state of being engaged with the bar insertion hole 8*d* of the inner cylinder main body 8*a*, and with the upper inner concave portions 12*d*, 13*d*, 14*d*, 15*d*, 15*d* and 15*d* at the upper of the first to third layer tumblers 12 to 14 and spacers 15, 15 and 15. Then, as shown in FIG. 3A, the locking bar 7 reaches a predetermined position, for example, a three o'clock position. Thereby, the apex angle of the triangle of the positioning mark 10*a* of the key insertion guide 10 is directed to the 3 o'clock position.

The rotation angle of the inner cylinder 8 is restricted by the rotation restricting grooves 8*g* and 8*h* provided in the inner cylinder 8 and the locking convex portion 5*j* of the outer cylinder 5 engaged therewith. The rotation angle is not limited to 90° and can be changed appropriately.

And then, at the 3 o'clock position, the key 2 is pulled outward from the key insertion slot 3. Then, the tumblers 12 to 14 in the first to third layers slightly rotate around the central axis in the clockwise or counterclockwise direction, respectively, in accordance with the bending angle of the key groove 2*e*. The first to third layer tumblers 12 to 14 have guide convex portions 12*e*, 13*e* and 14*e* engaged with the key groove 2*e* of the key 2.

Figure 3B:
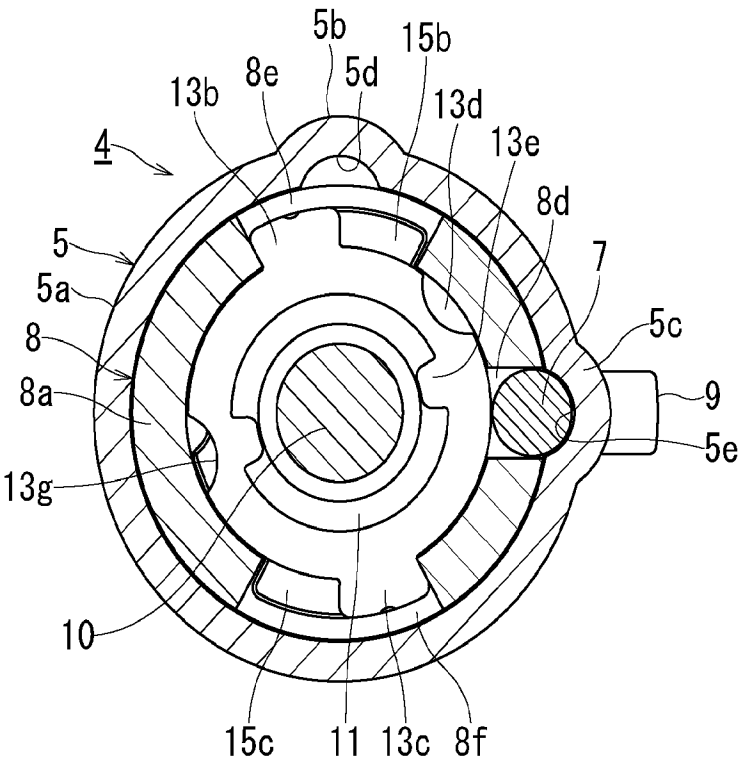
FIG. 3B is a cross-sectional view taken along a line II in FIG. 5 when the key is pulled out from the key insertion slot at the three o'clock position after FIG. 3A.
Figure 3A:
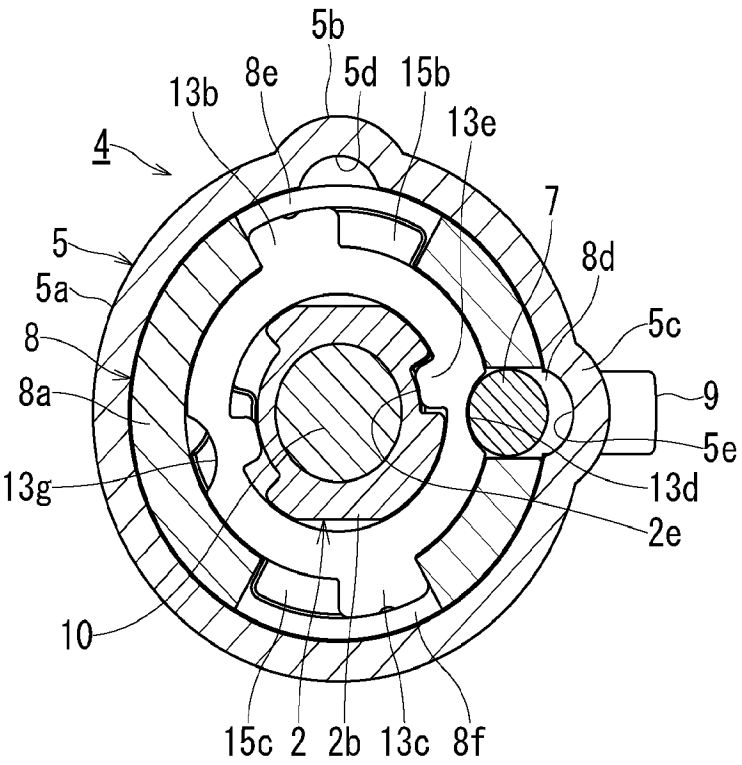
FIG. 3A is a cross-sectional view taken along a line II in FIG. 5 when the key is turned about 90°, for example.

Thereby, as shown in FIG. 3B, the locking bar 7 is pushed out from the upper inner concave portions 12*d*, 13*d* and 14*d* of the respective tumblers 12 to 14 to the outer peripheral surfaces of the respective tumblers 12 to 14 outside. Then, the locking bar 7 is pushed into the second outer concave portion 5*e* at the 3 o'clock position by the outer peripheral surfaces of the tumblers 12 to 14.

Thus, the locking bar 7 is interposed between the inner peripheral surface of the outer cylinder main body 5*a* and the outer peripheral surface of the inner cylinder main body 8*a* at the 3 o'clock position. That is, it is locked between the two main bodies 5*a* and 8*a*. Thereby, the further rotation of the inner cylinder main body 8*a* is blocked, and the blocked state has been maintained.

As described above, when the inner cylinder main body 8*a* is rotated by a predetermined central angle, the rod 9 fixed to the bottom of the inner cylinder main body 8*a* is also rotated by the same rotation angle as the rotation angle of the inner cylinder 8. As such, locking operation or unlocking operation can be performed. That is, for example, as shown in FIG. 1A, when the rod 9 is positioned at the 12 o'clock position, and when free tip is engaged with or locked in a locking receptacle such as a strike or the like (not shown), the rod 9 is rotated to the 3 o'clock position. The rod 9 is released from the strike, so it is unlocked.

It should be noted that the locking receptacle such as the strike may be arranged in the position of 3 o'clock. In this case, the locking position and the unlocking position are reversed as compared to the above case.

Then, as shown in FIG. 3B, the locking bar 7 reaches the 3 o'clock position, and rotation of the inner cylinder 8 is blocked. Thereafter, the shaft 2*b* of the key 2 is pulled out from the key insertion slot 3. As a result, all the tumblers 12 to 14 rotate in the opposite direction to that at the time of insertion of the shaft 2*b* of the key 2. That is, when the key 2 is pulled out, the upper guide convex portions 12*e*, 13*e* and 14*e* of the respective tumblers 12 to 14 of the first to third layers which have been engaged all the time in the key groove 2*e* are guided to the meandering angle (flexing angle) of the key groove 2*e*. Then, the tumbler main bodies 12*a*, 13*a* and 14*a* are slightly rotated in the opposite direction to that at the time of insertion of the shaft 2*b* of the key 2.

As described above, in the state in which the inner cylinder main body 8*a* is positioned at the 3 o'clock position, the positions of the inner concave portions 12*d*, 13*d* and 14*d* of the respective tumblers 12 to 14 of the first to third layers are in an unmatched state.

In the unmatched state, the shaft 2*b* of the key 2 is again inserted into the key insertion slot 3 of the cylinder lock 4. Then, the upper guide convex portions 12*e*, 13*e* and 14*e* of the tumblers 12 to 14 of the first to third layers are engaged in the key groove 2*e* in the same manner as at 12 o'clock. Then, each of the tumblers 12 to 14 of the first to third layers is guided by the key groove 2*e*, and rotates by a required angle.

As a result, all of the inner engagement recesses 12*d*, 13*d* and 14*d* are aligned at the three o'clock position. By rotating the key 2 counterclockwise, the inner cylinder 8 is rotated counterclockwise. Thereby, the locking bar 7 which has been engaged all the time in the second outer concave portion 5*e* of the outer cylinder 5 falls into the inner concave portions 12*d*, 13*d* and 14*d* of all the tumblers 12 to 14 through the bar insertion hole 8*d* of the inner cylinder body 8*a* by the same action as mentioned above regarding the 12 o'clock position. As a result, the inner cylinder main body 8*a* shifts to the rotatable state again.

Then, when the key 2 is further turned back to the 12 o'clock side, the locking bar 7 reaches the 12 o'clock position. As shown in FIG. 1A, it is pushed out into the first outer concave portion 5*d* at the 12 o'clock position by the same action as when reaching the above 3 o'clock position.

Thereby, the locking bar 7 is interposed and locked between the inner peripheral surface of the outer cylinder main body 5*a* and the outer peripheral surface of the inner cylinder main body 8*a*. As a result, the further rotation of the inner cylinder main body 8*a* is blocked and held at the 12 o'clock position.

In this way, the rod 9 rotates from the 3 o'clock position to the 12 o'clock position, so it is locked or unlocked again.

Therefore, according to the present locking device 1, it is possible to turn all the tumblers 12 to 14 simply by inserting and removing the shaft 2*b* of the key 2 into the key insertion slot 3 of the cylinder lock 4. Thereby, it is possible to rearise simplification of the entire configuration of the cylinder lock 4 and to reduce cost because the number of parts is reduced by omitting the driving member of the tumbler such as the spring.

Further, it is possible to further simplify the configuration of the cylinder lock 4. This is because it is possible to rearise the mechanism for rotating the first to third layers of the tumblers 12 to 14 by the simple configuration of the key groove 2*e* and the guide convex portions 12*e*, 13*e* and 14*e* engaged with the key groove 2*e* in a detachable manner.

Furthermore, it is possible to make the forgery more difficult than a flat plate key. This is because the shaft 2*b* of the key 2 is formed in a three-dimensional cylindrical isostatic shape. Also, the use of a forged key is prevented in advance, so it is possible to further enhance the difficulty to forge the key 2. This is because the key insertion slot 3 is provided with the guide ring 5*h* which allows only the shaft 2*b* of the regular key 2 to be inserted.

Furthermore, the key groove 2*e* is a groove for aligning the positions of all the inner concave portions 12*d*, 13*d* and 14*d* of the first to third layers of the tumblers 12 to 14 when the key 2 is inserted into the key insertion slot 3, and for returning to the original position. Therefore, the key groove 2*e* is required to have high accuracy. Since the further difficulty to forge the key 2 is enhanced, it is possible to further enhance the forgery prevention or reduction effect.

Furthermore, according to the present embodiment, the key insertion guide 10, the key insertion mark 2*c*, and the positioning mark 10*a* are provided. Thereby, it is possible to realize prevention of key misinsertion and smooth key insertion. Further, it is possible for a user to recognize the position of the rod 9 by the positioning mark 10*a* of the key insertion guide 10, and to recognize that the locking device 1 is either locking or unlocking.

Furthermore, a rotation restricting means for restricting the reversible rotation angle of the inner cylinder 8 is realized by the pair of rotation restricting grooves 8*g* and 8*h* of the inner cylinder 8 being engaged with the locking convex portion 5*j* of the outer cylinder 5. Thereby, it is possible to regulate the rotation angle of the inner cylinder 8 accurately and reliably.

Further, the highly slidable spacer 15 is inserted between the multiple tumblers 12 to 14. Thereby, it is possible to realize the certainty and the accuracy of the rotation of the tumblers 12 to 14. It should be noted that the spacer 15 may be omitted.

In the above embodiment, the case where only three tumblers 12 to 14 (three layers) are provided has been described. However, the present invention is not limited to this case, and one tumbler may be used, and one or more tumblers may be used.

The inner concave portions 12*d*, 13*d* and 14*d* and the guide convex portions 12*e* to 14*e* having different positions respectively may be provided. Further, multiple types of tumblers may be provided, and multiple combinations of multiple types of the tumblers corresponding to the two portions with different positional relationships respectively are provided. Thereby, it is possible to further enhance the forgery prevention or reduction effect.

Furthermore, the shape of the key groove 2*e* for driving the tumblers is complicated by providing the multiple types of combination patterns of multiple types of tumblers. As a result, it is possible to prevent the forgery of the key 2 and further improve the reduction effect.

In the above embodiment, the case where the key groove 2*e* is formed on the upper surface of the shaft 2*b* of the key 2 has been described as an example. However, it is not limited to that case. For example, the present invention may have the second key 2A provided with the second key groove 2*e*A on the lower surface on the diametrically opposite side, instead of the key groove 2*e*. In this case, when the second key 2A is inserted into the key insertion slot 3, the lower (second) guide convex portions 12*f*, 13*f* and 14*f* of the first to third layers of the tumblers 12 to 14 are engageably engaged with the second key groove 2*e*A and rotate. The inner cylinder 8 may be configured to be rotatable with the inner concave portions 12*d*, 13*d* and 14*d* of the tumblers 12 to 14 all in alignment with the required position.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

DESCRIPTION OF REFERENCE NUMERALS

1: locking device, 2: key, 2*a*: grip, 2*b*: shaft, 2*c* or 2*d*: key insertion mark, 2*e*: key groove (guide groove), 2*f*: key tip, 2*g*: key groove opening, 3: key insertion slot, 3*a*: rectangular concave portion, 4: cylinder lock, 5: outer cylinder, 5*a*: outer cylinder main body, 5*b*: first arc-shaped convex portion, 5*c*: second arc-shaped convex portion, 5*d*: first outer concave portion, 5*e*: second outer concave portion, 5*f*: open end, 5*g*: end plate, 5*h*: guide ring, 5*h*1: ring main body, 5*h*2: engaging portion, 5*j*: locking convex portion, 7: locking bar, 8: inner cylinder, 8*a*: inner cylinder main body, 8*b*: open end, 8*c*: bottom, 8*d*: bar insertion hole, 8*e* and 8*f*: pair of left and right engaged concave portions, 8*g* and 8*h*: pair of rotation restricting grooves, 9: rod, 10: key insertion guide, 10*a*: positioning mark, 11: annular space, 12, 13 and 14: first to third layer tumblers, 12*a*, 13*a* or 14*a*: tumbler main body, 12*b* and 12*c*: pair of left and right engaging portions, 13*b* and 13*c*: pair of left and right engaging portions, 14*b* and 14*c*: pair of left and right engaging portions, 12*d*, 13*d* or 14*d*: inner concave portion, 12*e*, 12*f*, 13*e*, 13*f*, 14*e* or 14*f*: guide convex portion, 15: spacer, 15*a*: spacer main body, 15*b* and 15*c*: pair of left and right engaging portions, 15*d* or 15*e*: inner concave portion

The invention claimed is:

1. A locking device comprising:

a key having a cylindrical shaft in which a guide groove is formed in an axial direction;

a cylinder lock including an outer cylinder, an inner cylinder including an inner cylinder main body positioned inside the inner cylinder main body rotatably, a rod fixed to the inner cylinder main body, a key insertion slot, a key insertion guide fixed to the inner cylinder main body so as to be located in the key insertion slot, and an engaged portion with which an engaging portion is engaged, a locking bar interposed between the inner cylinder and the outer cylinder, the locking bar being engageable with and removable from the inner cylinder and the outer cylinder, and the locking bar being configured to prevent rotation of the inner cylinder by locking, and a tumbler including a guide convex portion which engages with the guide groove of the key, an inner concave portion which is rotatably accommodated in the inner cylinder, the inner concave portion being configured to drop the locking bar, and an engaging portion which is provided so as to protrude radially outward at an outer peripheral portion of a tumbler main body and is rotatably engaged with the engaged portion of the inner cylinder, wherein the cylinder lock is configured such that when the shaft of the key is inserted inward along the key insertion guide from the key insertion slot of the inner cylinder, the tumbler having the guide convex portion engaged with the guide groove of the key is rotated in accordance with guide of the guide groove of the key, thereby the inner concave portion is aligned with a position of the locking bar, the locking bar is inserted radially into the bar insertion slot of the inner cylinder at start of rotation of the inner cylinder, the locking bar is dropped toward the inner concave portion side of the tumbler, thereby a locked state of the inner cylinder and the outer cylinder is released, and the inner cylinder is allowed to rotate at a predetermined angle.

2. A locking device comprising:

a key; and a cylinder lock including an inner cylinder rotating by the key, wherein the key includes a cylindrical shaft having an open front end, and a guide groove axially formed on the shaft, the cylinder lock includes an outer cylinder including a cylindrical outer cylinder main body which is open at both axial ends, and an outer concave portion formed on an inner circumferential surface of the outer cylinder main body and engaged with a radially outer end of a cylindrical locking bar, wherein the outer cylinder is formed by arranging multiple outer concave portions in a circumferential direction of the outer cylinder main body, an inner cylinder including a bottomed cylindrical inner cylinder main body rotatably accommodated in the outer cylinder, a rod provided so as to protrude radially outward on a bottom outer surface of the inner cylinder main body, a key insertion guide coaxially provided on center of a bottom inner surface of the inner cylinder main body to guide an insertion direction of the key, a bar insertion hole configured to radially penetrate a key insertion slot and the inner cylinder main body, the bar insertion hole radially inserting the locking bar toward center of the inner cylinder main body, the key insertion slot being formed in an outer peripheral gap of the key insertion guide, and the key insertion slot being in which the key is inserted, and an engaged portion with which an engaging portion is engaged, a locking bar which straddles the bar insertion hole of the inner cylinder and the outer concave portion of the outer cylinder, and the locking bar being engaged with the inner cylinder and the outer cylinder to prevent rotation of the inner cylinder, and a tumbler including an annular tumbler main body having a central hole through which the key insertion guide of the inner cylinder is inserted, a guide convex portion which protrudes toward center of an inner periphery portion of a central hole of the tumbler main body and engages with the guide groove of the key, an engaging portion which is provided so as to protrude radially outward at an outer peripheral portion of the tumbler main body and is rotatably engaged with the engaged portion of the inner cylinder, and an inner concave portion formed on the outer peripheral portion of the tumbler main body and engaged releasably with a radially inner end of the locking bar, wherein the cylinder lock is configured such that, when the shaft of the key is inserted inward along the key insertion guide from the key insertion slot of the inner cylinder, the tumbler having the guide convex portion engaged with the guide groove of the key is rotated in accordance with guide of the guide groove of the key to align the inner concave portion with a position of the locking bar, the locking bar is inserted into the bar insertion hole of the inner cylinder at start of rotation of the inner cylinder, a locked state of the inner cylinder and the outer cylinder is released by dropping the cylinder lock toward the inner concave portion side of the tumbler, and the inner cylinder is rotated by a predetermined angle.

3. The locking device according to claim 1, wherein the key insertion guide includes a free closure tip thereof in the key insertion slot.

4. The locking device according to claim 1, wherein the cylinder lock is configured such that, when the inner cylinder is rotated by a predetermined angle and the key is pulled out from the key insertion slot, the tumbler having the guide convex portion engaged with the guide groove of the key is rotated, and the locking bar is pushed and interposed between the outer cylinder and the inner cylinder to lock the outer cylinder and the inner cylinder, thereby prevents rotation of the inner cylinder.

5. The locking device according to claim 1, wherein the cylinder lock includes a rotation angle regulator configured to regulate the rotation angle of the inner cylinder.

6. The locking device according to claim 1, wherein the tumbler includes multiple layers, each layer being formed such that a position of the inner concave portion and a position of the guide convex portion are different in an insertion direction of the key.

7. The locking device according to claim 6, wherein a spacer is interposed between the multiple layers of the tumbler, surfaces of the spacer in contact with interposing layers being formed by a sliding surface.

8. The locking device according to claim 1, wherein the key insertion slot includes a guide ring for key insertion, the guide ring being formed with an insertion slot which conforms to a cross-section of the shaft of the key.

9. The locking device according to claim 1, wherein the key and the inner cylinder include marks each showing an insertion direction of the key.

10. The locking device according to claim 1, wherein the key includes a second key in which a second guide groove is formed on a diametrically opposite shaft, instead of the guide groove, the tumbler includes a second guide convex portion engaging with the second guide groove, and the second guide convex portion is engaged with the second guide groove by inserting the shaft of the second key into the key insertion slot of the inner cylinder, and a guide of the second guide groove is configured to rotate the tumbler so that the inner concave portion coincides with a position of the locking bar.

11. The locking device according to claim 2, wherein the key insertion guide includes a free closure tip thereof in the key insertion slot.

12. The locking device according to claim 2, wherein the cylinder lock is configured such that, when the inner cylinder is rotated by a predetermined angle and the key is pulled out from the key insertion slot, the tumbler having the guide convex portion engaged with the guide groove of the key is rotated, and the locking bar is pushed and interposed between the outer cylinder and the inner cylinder to lock the outer cylinder and the inner cylinder, thereby prevents rotation of the inner cylinder.

13. The locking device according to claim 2, wherein the cylinder lock includes a rotation angle regulator configured to regulate the rotation angle of the inner cylinder.

14. The locking device according to claim 2, wherein the tumbler includes multiple layers, each layer being formed such that a position of the inner concave portion and a position of the guide convex portion are different in an insertion direction of the key.

15. The locking device according to claim 14, wherein a spacer is interposed between the multiple layers of the tumbler, surfaces of the spacer in contact with interposing layers being formed by a sliding surface.

16. The locking device according to claim 2, wherein the key insertion slot includes a guide ring for key insertion, the guide ring being formed with an insertion slot which conforms to a cross-section of the shaft of the key.

17. The locking device according to claim 2, wherein the key and the inner cylinder include marks each showing an insertion direction of the key.

18. The locking device according to claim 2, wherein the key includes a second key in which a second guide groove is formed on a diametrically opposite shaft, instead of the guide groove, the tumbler includes a second guide convex portion engaging with the second guide groove, and the second guide convex portion is engaged with the second guide groove by inserting the shaft of the second key into the key insertion slot of the inner cylinder, and a guide of the second guide groove is configured to rotate the tumbler so that the inner concave portion coincides with a position of the locking bar.

* * * * *